United States Patent [19]

Ammon et al.

[11] Patent Number: 4,881,904

[45] Date of Patent: Nov. 21, 1989

[54] MODULAR ELECTRICAL CONNECTOR

[75] Inventors: J. Preston Ammon, Dallas; Jerry Kendal, Lewisville, both of Tex.

[73] Assignee: Augat Inc., Mansfield, Mass.

[21] Appl. No.: 246,874

[22] Filed: Sep. 20, 1988

[51] Int. Cl.[4] ..... H01R 9/09; H01R 4/58

[52] U.S. Cl. ..... 439/78; 439/83; 439/101; 439/712

[58] Field of Search ..... 439/78–83, 439/101, 262, 278, 282, 329, 368, 370, 591, 629, 634, 712, 714, 715

[56] References Cited

U.S. PATENT DOCUMENTS

| | | | |
|---|---|---|---|
| 3,771,101 | 11/1973 | Elkins | 439/78 |
| 3,883,210 | 5/1975 | Frejita et al. | 439/712 |
| 4,616,893 | 10/1986 | Feldman | 439/83 |
| 4,682,829 | 7/1987 | Kunkle et al. | 439/83 |
| 4,709,976 | 12/1987 | Nakama et al. | 439/712 |
| 4,762,500 | 8/1988 | Dola et al. | 439/83 |
| 4,808,115 | 2/1989 | Norton et al. | 439/79 |

*Primary Examiner*—P. Austin Bradley

*Attorney, Agent, or Firm*—Weingarten, Schurgin, Gagnebin & Hayes

[57] ABSTRACT

A 3-module electrical connector custom assembled for specific applications by mating together a central module and first and second contact modules to form an insulative housing for electrical contacts. The central module has a single row of contact receptacles for housing electrical ground, voltage or signal contacts. The first and second contact modules are selected from a group of preformed contact modules having configurations of from one to three rows. By proper selection of the first and second contact modules, a 3-module electrical connector can be custom assembled to have a predetermined number of rows of contact receptacles. The total number of contact rows can be odd or even numbered, and can be symmetrical or asymmetrical with respect to the single row of contact receptacles of the central module. The 3-module electrical connector can be used for insertion mounting of the terminal portions of the electrical contacts in corresponding holes of a printed circuit board. Alternatively, the 3-module electrical connector can be edge mated, with or without spacer blocks mated to the first and second modules, to a printed circuit board by positioning the first and second modules to dispose the terminal portions of the electrical contacts in single rows for high density surface mounting with the electrical contact pads disposed on the major surfaces of the printed circuit board.

17 Claims, 6 Drawing Sheets

MODULAR ELECTRICAL CONNECTOR

FIELD OF THE INVENTION

This invention relates to electrical connectors, and more particularly to a 3-module electrical connector for customized mating of non-standardized row configurations of electrical contacts with a printed circuit board.

BACKGROUND OF THE INVENTION

Prior art electrical connectors have generally been provided in standardized configurations for mating a fixed number of electrical contacts to a printed circuit board. Fixed number of contacts are positioned for mating by being disposed in the receptacles of an insulative housing. The receptacles of electrical connectors of standardized configurations are arranged in odd or even numbers of rows containing identical numbers of receptacles. Further, the rows of contact receptacles may be symmetrical or asymmetrical for a given connector.

Standardized configurations are formed by molding an insulative material into a housing having rows of receptacles which support or house the fixed number of contacts. Each standardized configuration requires individualized molding equipment to form one standardized housing having the required number of rows of receptacles.

Generally, each specific application requires an electrical connector capable of housing a specified number of electrical contacts in a particular row configuration. Several options are available to equipment manufacturers to ensure the availability of electrical connectors suitable for each specific application.

Firstly, an equipment manufacturer can fabricate a standardized housing configuration for each specific application as it occurs. This is generally not cost effective since the specialized mold equipment must be developed prior to fabricating the connector housings. In addition, such a process has an inherent time lag which is generally disadvantageous in the competitive business environment.

Secondly, the equipment manufacturer can store a limited stock of standardized connector configurations capable of housing predetermined numbers of electrical contacts. This option, however, is generally disadvantageous in that it will often be necessary to use a larger standardized connector configuration than required by the number of electrical contacts to be mated. This will result in unused receptacles and in general will cause the connector to occupy excessive space on the printed circuit board.

Lastly, the equipment manufacturer can store an extensive stock of standardized connector configurations to ensure a space-effective connector is available to house almost any predetermined number of electrical contacts. This option is disadvantageous in that excessive money and space is tied up in the extensive stock of standardized connector configurations.

SUMMARY OF THE INVENTION

The invention is an electrical connector comprising a central module and first and second contact modules that are custom assembled to form the 3-module electrical connector of the present invention. The first and second contact modules are preformed in configurations having one to three rows of contact receptacles for housing electrical contacts. The central module, in contrast, contains a single row of contact receptacles.

For a particular application, first and second contact modules having the necessary number of rows of contact receptacles are selected and custom assembled with the central module to form a 3-module electrical connector especially suited for the particular application. The diverse variety of first and second contact modules facilitates the assemblage of 3-module electrical connectors having a predetermined number of rows. The number of rows of contact receptacles for a particular 3-module configuration may be an odd or even number, and the total number of rows of contact receptacles can be either symmetrical or asymmetrical with respect to the central module.

Depending upon the application, the electrical contacts housed in the central module can function as ground, voltage or signal contacts. The electrical contacts housed in the first and second contact modules function as signal contacts. They can also act as voltage or ground contacts, but with a lower current carrying capability.

The 3-module electrical connector can be configured so that the terminal portions of the signal contacts of each of the first and second contact modules are orientated in a single row to facilitate high density edge mounting with the electrical contact pads disposed on the major surfaces of the printed circuit board. Alternatively, the 3-module electrical connector can be configured so that the terminal portions of the signal contacts of the first and second contact modules are arranged in planar rows for insertion into corresponding holes of the printed circuit board.

BRIEF DESCRIPTION OF THE DRAWINGS

A more complete understanding of the present invention and the attendant advantages and features thereof will be more readily understood by reference to the following detailed description when considered in conjunction with the accompanying drawings wherein.

DETAILED DESCRIPTION OF PREFERRED EMBODIMENTS

Figure 1:
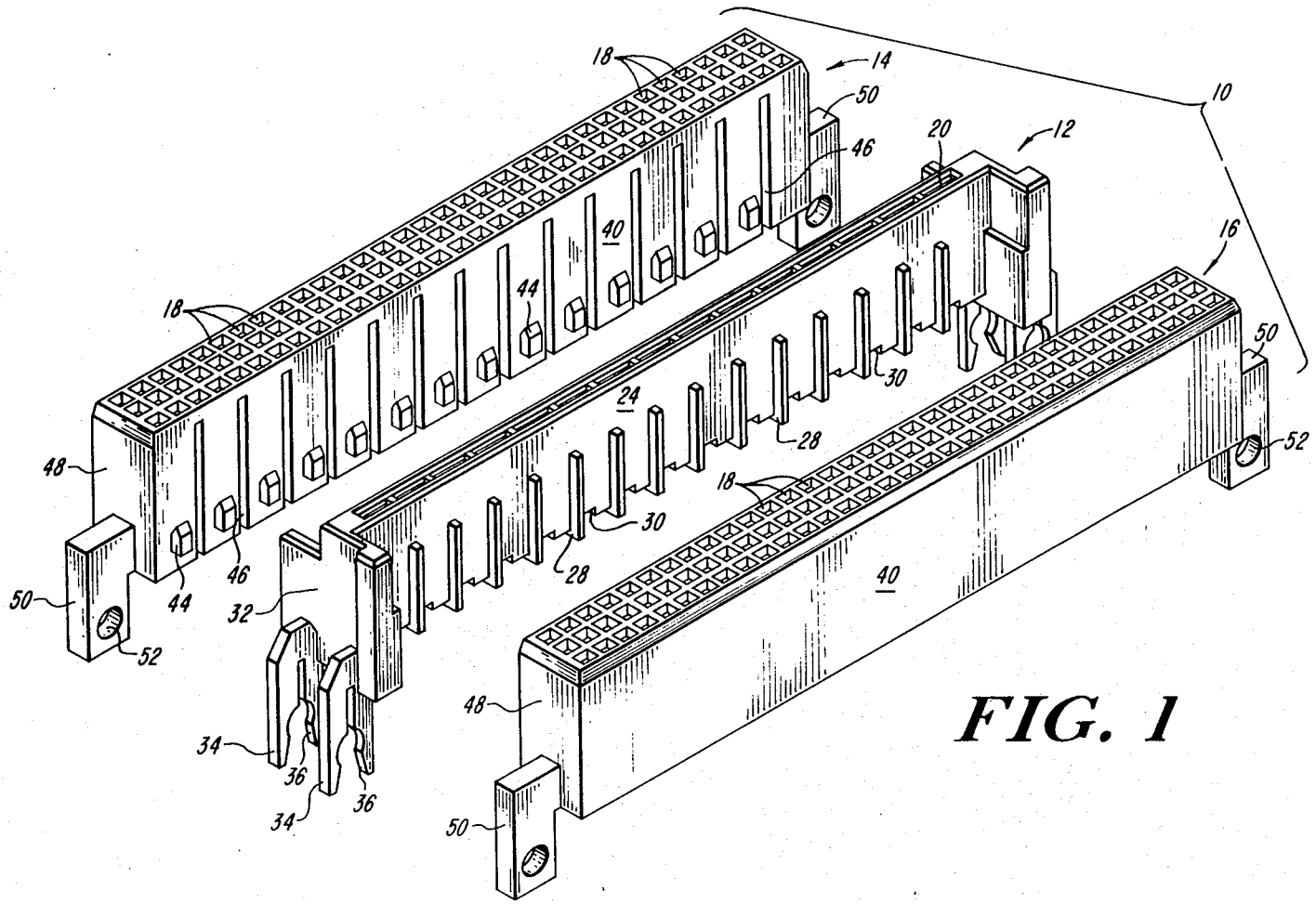
FIG. 1 is an exploded perspective view of a first embodiment of a 3-module electrical connector according to the present invention.

Referring now to the drawings wherein like reference numerals designate corresponding or similar elements throughout the several views, there is shown in FIG. 1 an exploded perspective view of a 3-module electrical connector 10 according to the present invention. The 3-module electrical connector 10 is a custom-assembled housing, formed from an insulative material, comprising a central module 12, a first contact module 14 and a second contact module 16.

For the exemplary embodiment of FIG. 1 the first and second contact modules 14, 16 each include three rows of contact receptacles 18 for housing electrical signal contacts. It is to be understood that each of the first and second contact modules 14, 16 can contain one to three rows of contact receptacles 18, depending upon the particular application. The number of receptacles 18 comprising each row is a predetermined number k, exemplarily illustrated in FIG. 1 as thirty-two.

It is to be further understood that the first and second contact modules 14, 16 may contain the same number of rows of contact receptacles 18 such that the custom-assembled 3-module electrical connector 10 is symmetrical with respect to the central module 12. Alternatively, the first and second contact modules 14, 16 may contain an unequal number of rows of contact receptacles 18 such that the custom-assembled 3-module electrical connector 10 is asymmetrical with respect to the central module 12. While each contact module 14, 16 can contain one to three rows of contact receptacles 18, preferable embodiments of the 3-module electrical connector 10 will be assembled from contact modules 14, 16 formed with two and/or three rows of contact receptacles 18, respectively.

The central module 12 has a single row of contact receptacles 20. The number of contact receptacles 20 comprising the single row is typically less than k, although the central module 12 may have k contact receptacles 20.

Figure 2A:
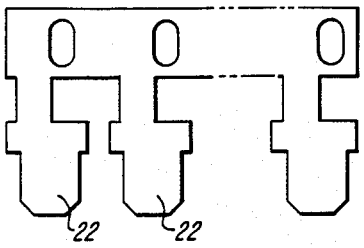
FIG. 2A is a plan view of electrical contacts configured for use in the central module.
Figure 2B:
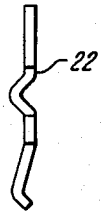
FIG. 2B is a cross-sectional view of the electrical contacts of FIG. 2A taken along line B—B thereof.

One particular configuration of electrical contacts 22 adapted to be housed in the contact receptacles 20 of the central module 12 is illustrated in plan view in FIG. 2A and in cross-section in FIG. 2B. The electrical contacts 22 typically function as ground contacts or voltage contacts, depending upon the particular application. The electrical contacts 22 disposed in the contact receptacles 20, however, can function as an extra row of electrical signal contacts if required by the particular application.

Thus, 3-module electrical connectors 10 custom assembled from the central module 12 having a single row of contact receptacles 20 and the first and second contact modules 14, 16 having two or three rows of contact receptacles 18, respectively, can be characterized as 5 row, 6 row or 7 row electrical connectors, depending upon the number of rows of contact receptacles 18 in contact modules 14, 16.

Figure 3:
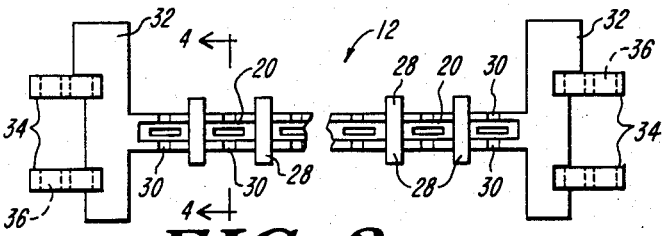
FIG. 3 is a top view of the central module of FIG. 1.
Figure 4:
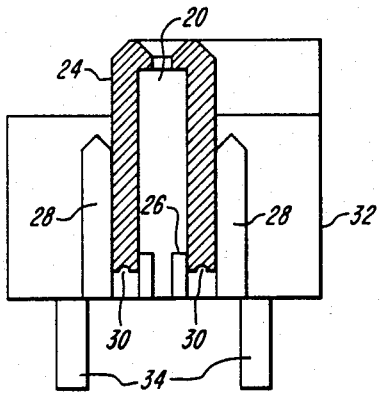
FIG. 4 is a cross-sectional view of the central module of FIG. 3 taken along line 4—4 thereof.

The central module 12, as illustrated in greater detail in FIGS. 3 and 4, is integrally formed as a unit from insulative material to include a body portion 24 containing the single row of contact receptacles 20, at least one shoulder 26 formed within each receptacle 18, a plurality of ribs 28 depending outwardly from each of the major sidewalls of the body portion 24 along its length, a plurality of notches 30 formed intermediate adjacent ribs 28, and end members 32, 32. Extending outwardly from each end member 32 is a pair of mating flanges 34, 34. Each mating flange 32 includes a slot 36 which is used in final assemblage of the 3-module connector 10, as discussed hereinbelow in greater detail.

The first and second contact modules 14, 16 are also integrally formed as units from insulative material. Because of the configuration of the first and second modules 14, 16, only one form/design is required to fabricate the contact module 14, 16. This feature simplifies manufacturing and reduces costs.

Figure 6:
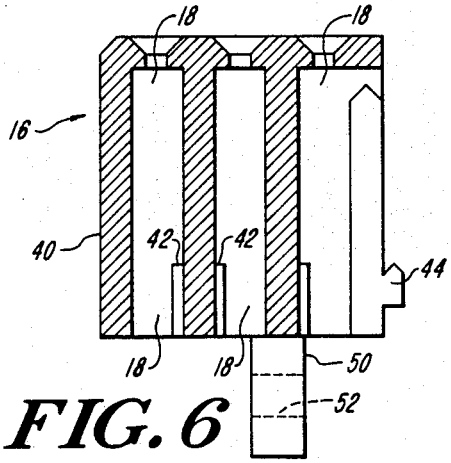
FIG. 6 is a cross-sectional view of the contact module of FIG. 5 taken along line 6—6 thereof.
Figure 5:
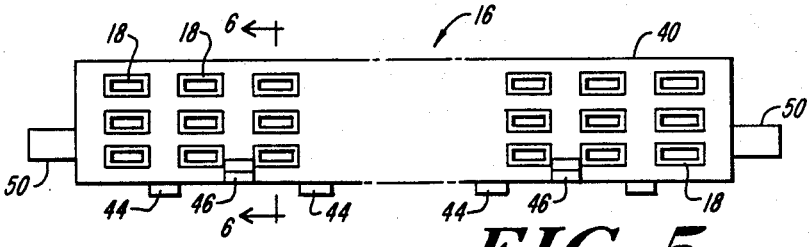
FIG. 5 is a bottom view of a contact module of the embodiment of FIG. 1.

Each contact module 14, 16, as illustrated in greater detail in FIGS. 5 and 6, includes a body portion 40, and at least one shoulder 42 formed within each receptacle 18 for engagement of the corresponding contact disposed therein. The sidewalls of the body portions 40 of the first and second contact modules 14, 16 to be mated with the central module 12 are formed to have a plurality of projections 44 depending outwardly therefrom, as illustrated in FIG. 6. The projections 44 are formed to register with the notches 30 of the central module 12 during assemblage of the 3-module electrical connector.

A plurality of slots 46 are formed in the same sidewalls as the projections 44 intermediate adjacent projections 44. The slots 46 are formed to register with the depending ribs 28 of the central module 12 during assemblage. Each body portion 40 terminates in end faces 48, 48.

Extending from each end face 48 is a corresponding flange 50 having a hole 52 formed therethrough. During final assemblage of the 3-module electrical connector 10 the corresponding flanges 50 of the first and second contact modules 14, 16 are aligned with the paired mating flanges 34, 34 of the central module 12 such that the holes 52 align with the slots 36.

The 3-module electrical connector 10 described in the preceding paragraphs is disposed for surface mounting with the printed circuit board by having the bottom surface thereof adjacent a major surface of the printed circuit board. With this disposition, the terminal portions of electrical signal contacts housed in the rows of contact receptacles 18 of the first and second contact modules 14, 16, respectively, extend beyond the bottom surface of the respective contact modules 14, 16 for insertion into corresponding holes in the printed circuit board. The terminal portions of the electrical signal contacts are arranged in parallel row configurations corresponding to the row configuration of contact receptacles 18.

Figure 7:
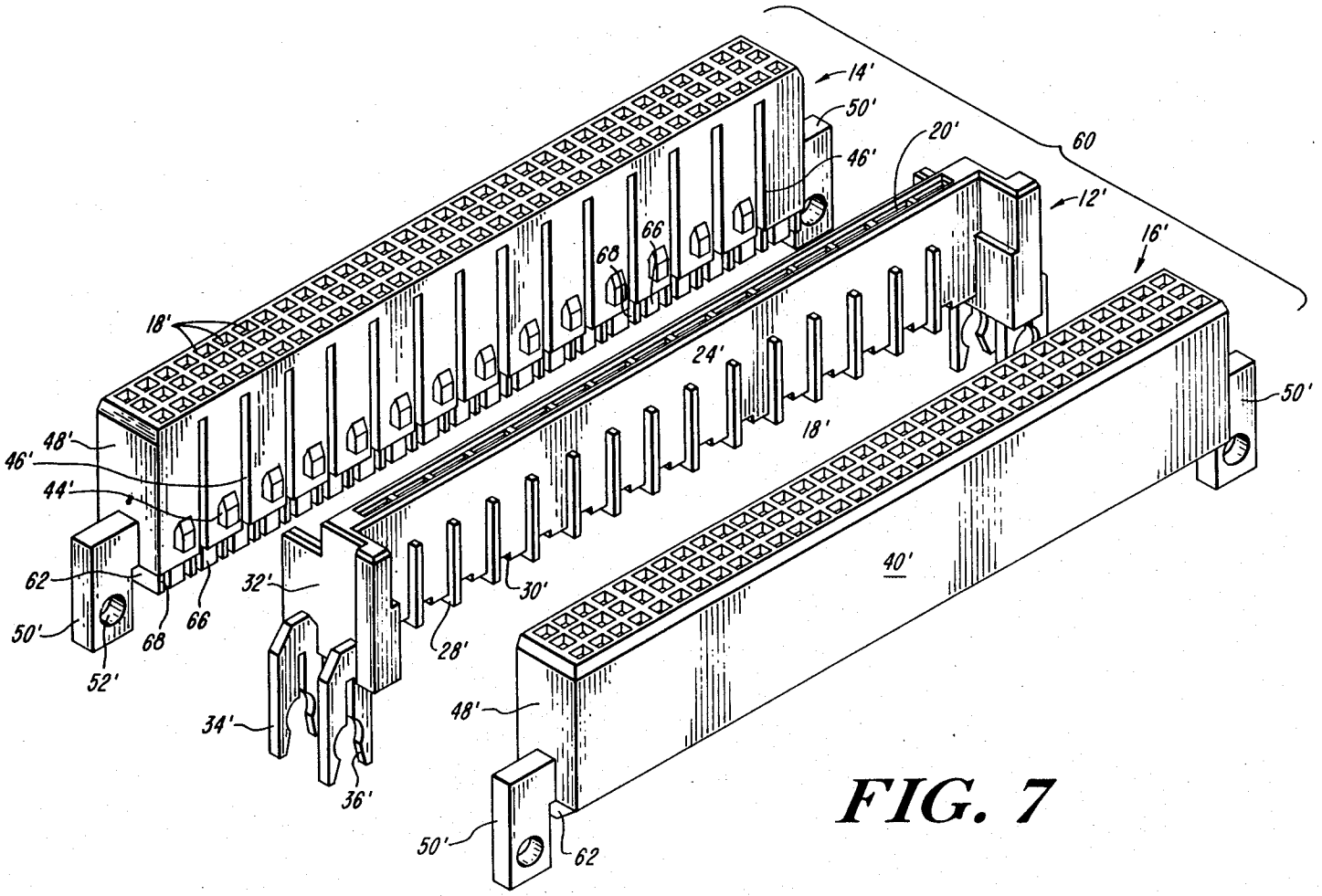
FIG. 7 is an exploded perspective view of an alternative embodiment of a 3-module electrical connector according to the present invention.

An alternative embodiment of a 3-module electrical connector 60 according to the present invention is depicted in FIG. 7. The 3-module electrical connector 60 is configured for edge connection to a printed circuit board in a manner similar to that of the MULTI ROW HIGH DENSITY CONNECTOR disclosed in U.S. Pat. No. 4,734,042, commonly owned by the assignee of the present application.

The structural configuration and elements of the 3-module electrical connector 60 exemplarily illustrated in FIG. 7 are generally similar to the structural configuration and elements of the 3-module electrical connector 10 discussed hereinabove. The terminal portions of the electrical signal contacts disposed in the receptacles 18′ of the 3-module electrical connector 60 extend beyond the bottom surface of each contact module 14', 16' in a single row to facilitate high density edge mating with contact pads disposed on the major surfaces of the printed circuit board.

To provide proper spacing and alignment for the terminal portions of the electrical signal contacts, spacing blocks 62 may be utilized to space/align the terminal portions of the contacts. Alternatively, the contacts disposed in the receptacles 18' of the contact modules 14', 16' may be formed with terminal portions having a configuration which ensures proper spacing and alignment thereof as single rows such that the spacing blocks 62 of FIG. 7 are not needed.

For the embodiment depicted in FIG. 7, the spacing blocks 62 are separate elements which are mated with the underside of corresponding contact modules 14', 16'. This is the most cost effective manner of custom assembling the 3-module electrical connector 60, since it requires only one configuration for the contact modules 14, 16/14', 16' which may be used in either the 3-module electrical connector 10 of FIG. 1 or the 3-module electrical connector 60 of FIG. 7. It is to be understood, however, that the contact modules 14', 16' can be formed in such manner that the spacing blocks 62 are integrally formed with the corresponding body portion 40'.

Figure 8:
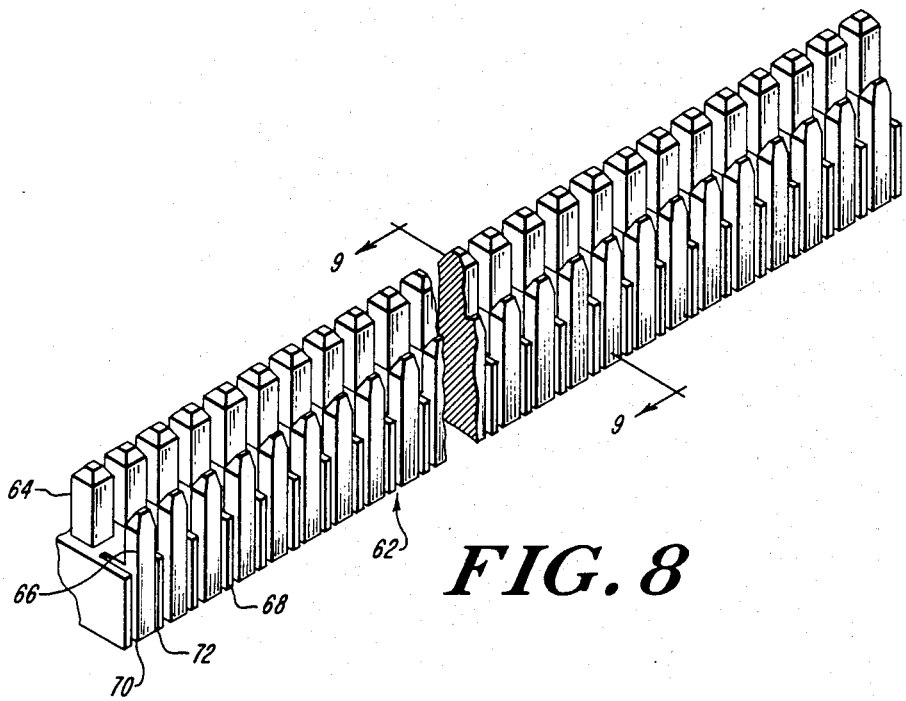
FIG. 8 is a perspective view of a spacer block for use with the 3-module electrical connector of FIG. 7.

As shown in greater detail in FIG. 8 the spacing block 62 includes a first plurality of mating posts 64 and a second plurality of mating posts 66. The first and second pluralities of mating posts 64, 66 are inserted into corresponding receptacles 18' of the contact modules 14', 16' to effectuate mating therebetween. The spacing block 62 also includes a plurality of demi-posts 68, with one demi-post 58 interposed between adjacent ones of the second plurality of mating posts 66.

Figure 9:
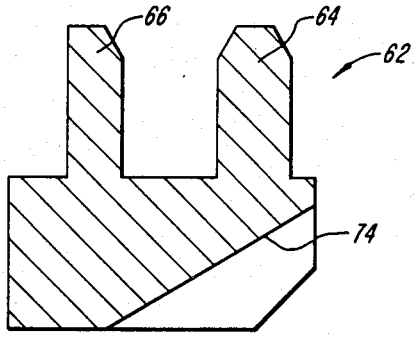
FIG. 9 is a cross-sectional view of the spacer block of FIG. 8 taken along line 9—9 thereof.

The spacing between the plurality of demi-posts 68 and the second plurality of mating posts 66 creates first and second pluralities of slots 70, 72 in one face of the spacing block 62. A third plurality of slots 74, shown more clearly in FIG. 9, are formed in the opposed face of the spacing blocks 62. The terminal portions of the electrical signal contacts are disposed in predetermined relation in the first, second and third pluralities of slots 70, 72, 74 such that the terminal portions are aligned in a single row for surface mating with the electrical contact pads disposed on the major surfaces of the printed circuit board.

Figure 10:
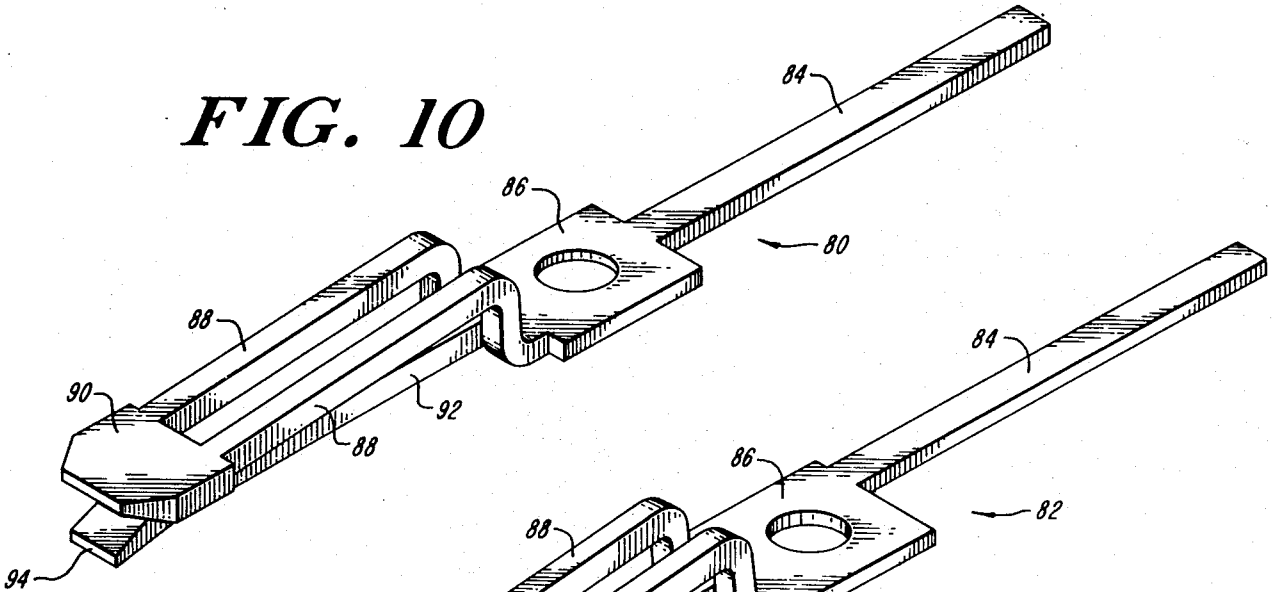
FIG. 10 is a perspective view of a symmetrical electrical signal contact for use in the first and second contact modules of the embodiment of FIG. 7.
Figure 11:
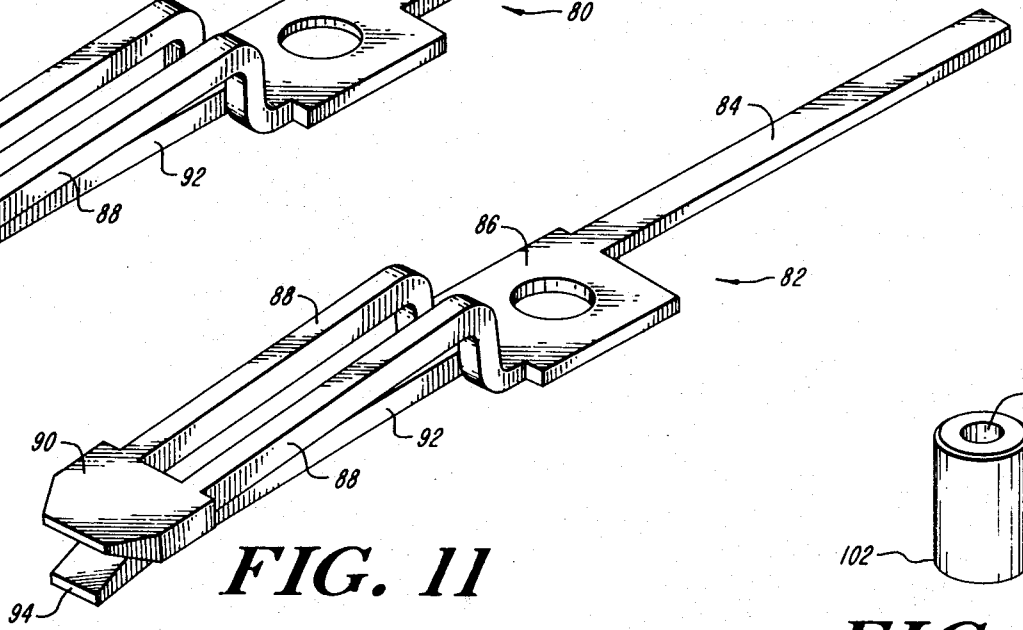
FIG. 11 is a perspective view of an asymmetrical electrical signal contact for use in the first and second contact modules of the embodiment of FIG. 7.

Two configurations of electrical signal contacts are used with the 3-module electrical connector 60. A symmetrical contact 80 is illustrated in FIG. 10 while an asymmetrical contact 82 is depicted in FIG. 11. Each contact 80, 82 includes a terminal portion 84 extending from a one side of a central portion 86. Extending from the other side of the central portion 86 of each contact 80, 82 are offset arm members 88, 88 terminating in a contact end 90 and a single arm member 92 terminating in a contact end 94.

Structurally the contacts 80, 82 are identical except for the positioning of the terminal portion 84 vis-a-vis the central portion 86. By rotating the asymmetrical contact 82 through an angle of 180° with respect to its longitudinal axis the asymmetrical contact 82 can effectively function as both right and left asymmetric electrical signal contacts.

For one embodiment, the terminal portions 84 of the contacts 80, 82 are bent prior to insertion thereof in the contact receptacles 18'. By predetermined bending and disposition of the contacts 80, 82, the terminal portions 84 extending beyond the bottoms of the contact modules 14', 16' are arranged in single rows. Adjacent terminal portions 84 are preferably equidistantly spaced.

Alternatively, by disposing the symmetrical and asymmetrical contacts 80, 82 in predetermined relation in the first, second and third pluralities of slots 70, 72, 74 of the spacing blocks 62, the terminal portions 84 are arranged in single rows depending from the bottom surfaces of the contact modules 14', 16'. Adjacent terminal portions 84 are preferably equidistantly spaced.

Figure 12:
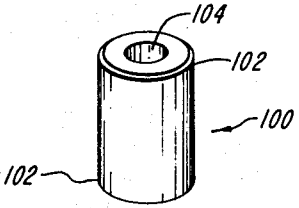
FIG. 12 depicts a bushing having utility in aligning the first and second contact modules with the central module during assemblage.

Illustrated in FIG. 12 is a bushing 100 used to position the first and second contact modules with respect to the central module. The bushing 100 is a rod having first and seconds ends 102, 102. The embodiment shown in FIG. 12 has an bore 104 extending therethrough.

The first step in the custom assemblage of a 3-module electrical connector according to the present invention requires a determination as to the number of rows of contact receptacles that each contact module will have. The electrical contacts are then inserted into corresponding receptacles in the central module and the first and second contact modules. Next, the central module is mated with the printed circuit board in such manner that the terminal portions of the central module electrical contacts are engaged.

The terminal portions may engage a ground plane, or a voltage plane, or individual signal paths of the printed circuit board, depending upon the particular application. When the electrical contacts of the central module are functioning as ground or voltage contacts, the location is not critical since ground and voltage leaks are typically relatively large.

Bushings 100 are inserted in the slots 36 of the paired flanges 34 of the central module and extend beyond the outer surfaces of the flanges 34. The first and second contact modules are then precisely positioned in relation to the central module by inserting the ends 102, 102 of the bushings 100 into the holes 50 of the corresponding flanges 48 of the first and second contact modules.

Figure 13:
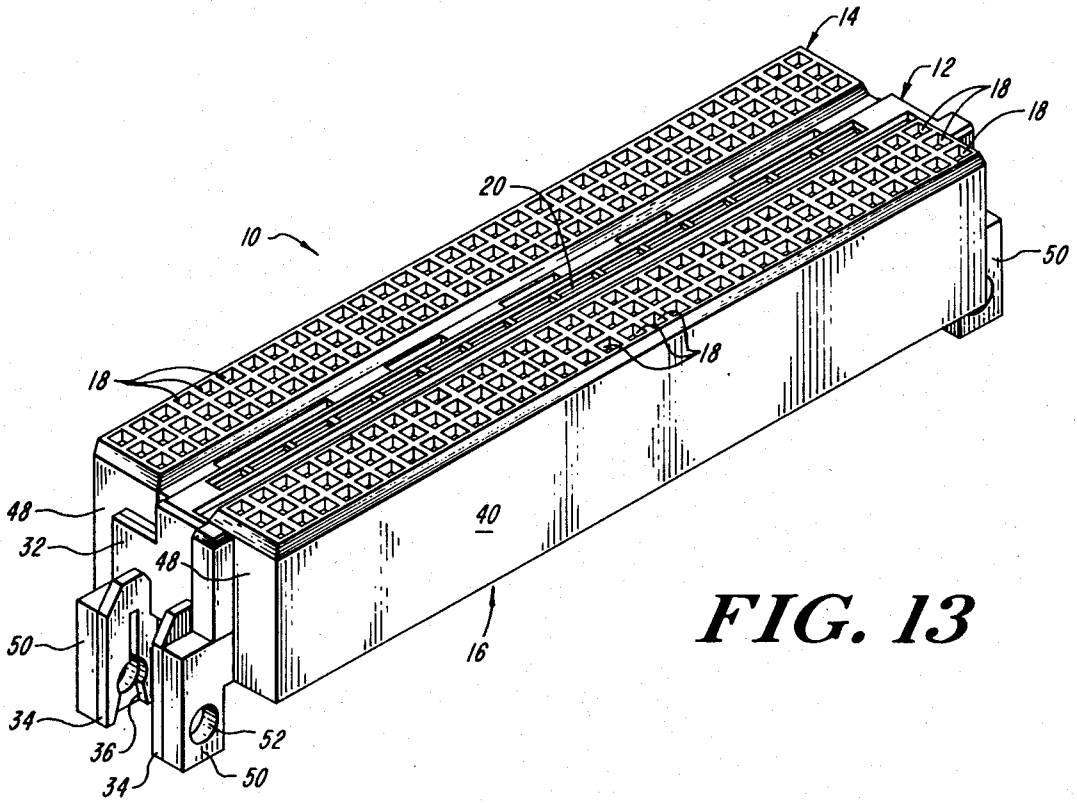
FIG. 13 illustrates the 3-module electrical connector of FIG. 1 in assembled state (without bushing).

The depending ribs 28 of the central module interfit with the slots 46 of the first and second contact modules and the projections 44 of the first and second contact modules interfit with notches 30 of the central modules with the 3-module electrical connector in the assembled state. The interfit arrangement facilitates heat dissipation from the modular electrical connector. The custom-assembled 3-module electrical connector of the present invention, as shown in FIG. 13 without the bushing, minimizes signal leak length through the electrical signal contacts mounted in the first and second contact modules.

A variety of modifications and variations of the present invention are possible in light of the above teachings. It is therefore to be understood that within the scope of the appended claims, the present invention may be practiced otherwise than as specifically described hereinabove.

We claim:

1. A modular electrical connector for mounting a first and second plurality of electrical contacts in electrical connection with a printed circuit board, comprising:

a central module having a plurality of contact receptacles configured to receive the first plurality of electrical contacts;

a first contact module having a plurality of contact receptacles arranged in X rows, and wherein said plurality of contact receptacles are configured to receive electrical contacts of the second plurality;

a second contact module having a plurality of contact receptacles arranged in Y rows, and wherein said plurality of contact receptacles are configured to receive electrical contacts of the second plurality; and means associated with said central module and said first and second contact modules for assembling said central module and said first and second modules in combination to form said modular electrical connector.

2. The modular electrical connector of claim 1 wherein terminal portions of the second plurality of electrical contacts are configured to depend substantially orthogonal from bottom surfaces of said first and second contact modules, respectively, to form K and N parallel rows of terminal portions for surface mounting of said modular electrical connector with the printed circuit board.

3. The modular electrical connector of claim 1 wherein terminal portions of the second plurality of electrical contacts are configured to depend acutely from bottom surfaces of said first and second contact modules, respectively, to form single rows of terminal portions for edge mounting of said modular electrical connector with the printed circuit board.

4. The module electrical connector of claim 1 wherein the first plurality of electrical contacts configured to be disposed in said contact receptacles of said central module are ground contacts and wherein the second plurality of electrical contacts configured to be disposed in said contact receptacles of said first and second contact modules are signal contacts.

5. The modular electrical connector of claim 1 wherein the first plurality of electrical contacts configured to be disposed in said contact receptacles of said central module are voltage contacts and wherein the second plurality of electrical contacts configured to be disposed within said contact receptacles of said first and second contact modules are signal contacts.

6. The modular electrical connector of claim 1 wherein the first plurality of electrical contacts configured to be disposed in said contact receptacles of said central module are signal contacts and wherein the second plurality of electrical contacts configured to be disposed within said contact receptacles of said first and second contact modules are signal contacts.

7. The module electrical connector of claim 1 wherein said central module has major sidewalls and each of said first and second contact modules has an interfacing sidewall, and wherein said assembling means comprises:

a plurality of ribs depending outwardly from said major sidewalls of said central module and spaced along the length thereof;

each of said major sidewalls having a plurality of notches formed therein intermediate adjacent ones of said purality of ribs along the lengths thereof;

a plurality of projections depending outwardly from said interfacing sidewalls of said first and second contact modules, respectively, along the lengths thereof; and each interfacing sidewall of said first and second contact modules includes a plurality of slots formed therein intermediate adjacent ones of said plurality of projections along the length thereof;

wherein said plurality of ribs of said central module interfit with said plurality of slots of said first and second contact modules and said plurality of projections of said first and second contact modules interfit with said plurality of notches of said central module to form said modular electrical connector, interfitting precluding relative longitudinal movement between said central module and said first and second contact modules.

8. The modular electrical connector of claim 1 wherein said central module further includes end members and wherein said first and second contact modules further include end faces, and wherein said assembling means further comprises:

a pair of mating flanges depending outwardly from each said end member of said central module, each said mating flange having a slot formed therein; and a corresponding flange extending from each of said end faces of said first and second contact modules, respectively, and wherein each said corresponding flange has a hole formed therethrough; and wherein said modular electrical connector further includes:

a pair of bushings, each of said pair of bushings configured to be inserted in said slots of said pair of mating flanges and said holes of said corresponding flanges of said first and second contact modules at each end of said modular electrical connector to form said modular electrical connector.

9. The modular electrical connector of claim 1 wherein K is equal to N such that said first and second contact modules form a symmetric arrangement about said central module.

10. The modular electrical connector of claim 9 wherein N is equal to K is equal to two.

11. The modular electrical connector of claim 9 wherein N is equal to K is equal to three.

12. The modular electrical connector of claim 1 wherein N is unequal to K such that said first and contact second modules form an asymmetric arrangement about said central module.

13. The modular electrical connector of claim 12 wherein N is equal to one and wherein K is equal to two.

14. The modular electrical connector of claim 12 wherein N is equal to one and wherein K is equal to three.

15. The modular electrical connector of claim 12 wherein N is equal to two and wherein K is equal to three.

16. The modular electrical connector of claim 1 further comprising:

a first spacing block mated to the bottom of said first contact module and wherein said first spacing block coacts with terminal portions of the second plurality of electrical contacts depending outwardly from the bottom of said first contact module in K parallel rows to form a single row of terminal contacts for surface mounting with the printed circuit board; and a second spacing block mated with the bottom of said second contact module, and wherein said second spacing block coacts with terminal portions of the second plurality of electrical contacts depending outwardly from the bottom of said second contact module in N parallel rows to form a single row of terminal contact ends for surface mounting with the printed circuit board.

17. The modular electrical connector of claim 16 wherein each of said first and second spacing blocks includes a first plurality of mating posts and a second plurality of mating posts configured for insertion into corresponding ones of said contact receptacles of said first and second contact modules, respectively, for mating therebetween.

* * * * *